US009350065B2

(12) United States Patent
Zhou

(10) Patent No.: US 9,350,065 B2
(45) Date of Patent: May 24, 2016

(54) METHOD FOR MANUFACTURING RESONANCE TUBE, RESONANCE TUBE, AND FILTER

(71) Applicant: Huawei Technologies Co., Ltd., Shenzhen (CN)

(72) Inventor: Yanzhao Zhou, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 573 days.

(21) Appl. No.: 13/728,259

(22) Filed: Dec. 27, 2012

(65) Prior Publication Data

US 2013/0113578 A1 May 9, 2013

Related U.S. Application Data

(63) Continuation of application No. PCT/CN2012/072175, filed on Mar. 12, 2012.

(30) Foreign Application Priority Data

Mar. 16, 2011 (CN) ..... 2011 1 0063303

(51) Int. Cl.
*H01P 11/00* (2006.01)
*H01P 7/06* (2006.01)
(Continued)

(52) U.S. Cl.
CPC ..... *H01P 11/008* (2013.01); *B22F 1/0014* (2013.01); *B22F 1/0059* (2013.01);
(Continued)

(58) Field of Classification Search
CPC ..... B22F 5/106
USPC ..... 419/30
See application file for complete search history.

(56) References Cited

U.S. PATENT DOCUMENTS 2,977,225 A 3/1961 Wlodek et al.
3,676,730 A 7/1972 Loughridge et al.
(Continued)

FOREIGN PATENT DOCUMENTS

CH 613 358 A 9/1979
CN 1131702 A 9/1996
(Continued)

OTHER PUBLICATIONS

First Chinese Office Action of Chinese Application No. 201110063314.2 mailed Aug. 3, 2012, 7 pages.
(Continued)

*Primary Examiner* — Jessee Roe
*Assistant Examiner* — Christopher Kessler
(74) *Attorney, Agent, or Firm* — Slater Matsil, LLP

(57) ABSTRACT

A method for manufacturing a resonance tube includes: mixing powder materials, to form homogeneous powder particles, where the powder materials comprise iron powder with a weight proportion of 50% to 90%, at least one of copper powder and steel powder with a weight proportion of 1% to 30%, and an auxiliary material with a weight proportion of 1% to 20%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube. In the method, the resonance tube, and the filter according to embodiments of the present invention, the resonance tube is manufactured by using multiple powder materials.

26 Claims, 4 Drawing Sheets

(51) Int. Cl.

| | |
|---|---|
| ***B22F 1/00*** | (2006.01) |
| ***B22F 3/10*** | (2006.01) |
| ***B22F 3/26*** | (2006.01) |
| ***B22F 9/04*** | (2006.01) |
| ***C22C 33/02*** | (2006.01) |
| ***C25D 5/10*** | (2006.01) |
| ***C25D 5/36*** | (2006.01) |
| ***C25D 7/04*** | (2006.01) |
| *B22F 3/24* | (2006.01) |
| *C22C 5/06* | (2006.01) |
| *C22C 9/00* | (2006.01) |

(52) U.S. Cl.

CPC ..... *B22F3/1007* (2013.01); *B22F 3/26* (2013.01); *B22F 9/04* (2013.01); *C22C 33/0207* (2013.01); *C22C 33/0228* (2013.01); *C22C 33/0257* (2013.01); *C25D 5/10* (2013.01); *C25D 5/36* (2013.01); *C25D 7/04* (2013.01); *H01P 7/06* (2013.01); *H01P 11/007* (2013.01); *B22F 2003/242* (2013.01); *B22F 2009/043* (2013.01); *C22C 5/06* (2013.01); *C22C 9/00* (2013.01)

(56) References Cited

U.S. PATENT DOCUMENTS

| | | | | |
|---|---|---|---|---|
| 3,725,091 | A | 4/1973 | Chyung et al. | |
| 3,742,283 | A | 6/1973 | Loughridge | |
| 3,894,169 | A | 7/1975 | Miller | |
| 4,112,398 | A | 9/1978 | Burnett et al. | |
| 5,972,067 | A | 10/1999 | Ishibashi et al. | |
| 7,456,711 | B1 | 11/2008 | Goldsmith | |
| 7,530,874 | B2 | 5/2009 | Hataoka et al. | |
| 8,986,420 | B2 * | 3/2015 | Zhou | B22F 1/0003 75/252 |
| 2001/0045246 | A1 | 11/2001 | Baudry et al. | |
| 2009/0034203 | A1 | 2/2009 | Terao et al. | |
| 2009/0302974 | A1 | 12/2009 | Lyons et al. | |
| 2010/0037451 | A1 | 2/2010 | Cheng | |
| 2010/0147307 | A1 | 6/2010 | Narciso | |
| 2010/0233014 | A1 | 9/2010 | Larsson | |

FOREIGN PATENT DOCUMENTS

| | | | |
|---|---|---|---|
| CN | 1538483 | A | 10/2004 |
| CN | 101384739 | A | 3/2009 |
| CN | 101638735 | A | 2/2010 |
| CN | 101656341 | A | 2/2010 |
| CN | 201417811 | Y | 3/2010 |
| CN | 101708549 | A | 5/2010 |
| CN | 101820002 | A | 9/2010 |
| CN | 101842178 | A | 9/2010 |
| CN | 101857943 | A | 10/2010 |
| CN | 101867077 | A | 10/2010 |
| CN | 101877427 | A | 11/2010 |
| CN | 101882703 | A | 11/2010 |
| CN | 101886192 | A | 11/2010 |
| CN | 101912967 | A | 12/2010 |
| CN | 102145977 | A | 8/2011 |
| CN | 102214852 | A | 10/2011 |
| FR | 2 374 774 | A1 | 7/1978 |
| JP | 10-190325 | A | 7/1998 |
| WO | WO 2008/139499 | A1 | 11/2008 |

OTHER PUBLICATIONS

United States Office Action received in U.S. Appl. No. 13/761,520 mailed May 2, 2014, 27 pages.

First Office Action of Chinese Application No. 201110063303.4 mailed Apr. 15, 2013, 12 pages. (Partial Translation).

Second Office Action of Chinese Application No. 201110063314.2 mailed May 6, 2013, 8 pages. (Partial Translation).

International Search Report received in International Application No. PCT/CN2012/072175, mailed Jun. 28, 2012, 17 pages.

International Search Report received in International Application No. PCT/CN2012/072179, mailed Jun. 21, 2012, 14 pages.

* cited by examiner

METHOD FOR MANUFACTURING RESONANCE TUBE, RESONANCE TUBE, AND FILTER

This application is a continuation of International Application No. PCT/CN2012/072175, filed on Mar. 12, 2012, which claims priority to Chinese Patent Application No. 201110063303.4, filed on Mar. 16, 2011, both of which are hereby incorporated by reference in their entireties.

TECHNICAL FIELD

The present invention relates to the field of communications, and in particular, to a method for manufacturing a resonance tube, a resonance tube, and a filter.

BACKGROUND

A duplexer of a base station transceiver is formed by a radio frequency cavity filter, where the radio frequency cavity filter is generally located on a back mechanical part of a board of the transceiver and is configured to transmit a single-channel high-power signal. Due to an effect of a material thermal expansion characteristic, a filtering characteristic of the filter also varies with a temperature change. Particularly, the temperature has an extraordinarily prominent effect on a filtering characteristic of a narrowband cavity filter. Generally, a change of the temperature brings about a frequency band drift to a radio frequency index, commonly known as "temperature drift", which causes a decrease in functions of a radio frequency system. Moreover, as mobile communications evolve to a high frequency band, the temperature drift phenomenon becomes increasingly serious, for example, for a cavity filter in a worldwide interoperability for microwave access (Worldwide Interoperability for Microwave Access, "WiMAX" for short) 2.6 GHz or 3.5 GHz standard, the frequency band drift phenomenon brought about by the change of temperature to the cavity filter has been very serious. A metal resonance tube manufactured by adopting a conventional aluminum alloy die casting and machining has difficulties to meet requirements of high-speed development of the communications technologies for the radio frequency index, which has been a main reason for hindering development of the high frequency band cavity filter.

By studying a relationship between a frequency of a cavity filter and a change of the temperature, it may be found that, each component dimension of a resonance tube in the cavity filter, for example, a width or diameter of a tuning screw, a width or diameter of a cavity, or a diameter or height of the resonance tube, may cause a change to the single cavity resonance frequency of the resonance tube or filter. Moreover, different component dimensions have different effects on the frequency of the filter when the temperature changes, for example, when the temperature rises, the height of the cavity causes a frequency change trend of the filter, in which the frequency change trend is quite the opposite to that caused by a height of a tuning rod. Therefore, temperature compensation may be performed on the cavity filter by using the characteristic.

Experimental studies show that, for a cavity filter without temperature compensation, when the temperature is +25° C., a central frequency of the filter is 2.4 GHz, while when the temperature changes to −40° C., the central frequency of the filter offsets to 2.4035 GHz, and the frequency offset is 3.5 MHz. Therefore, for the cavity filter without temperature compensation, when the temperature changes, a passband of the filter offsets, so at edge frequency points of a use frequency, an insertion loss is very high, and out-of-band rejection becomes worse, thereby directly causing deterioration of electrical properties of the filter and a decrease in system performance of the transceiver.

For a cavity filter on which temperature compensation is performed through the foregoing method, when the temperature changes from −40° C. to +25° C., the frequency variation of the filter may be less than 0.1 MHz, and a zero temperature drift may almost be implemented, thereby guaranteeing that the electrical properties of the cavity filter do not change at different temperatures.

By changing a component dimension of a cavity filter, temperature compensation may be performed on the cavity filter, but the changed component dimension may affect a Q value (quality factor) of the cavity. When the cavity dimension increases, the Q value of the cavity increases, and the size of the product also increases obviously; while when the cavity dimension decreases, the Q value of the cavity decreases, thereby obviously worsening an insertion loss index of the filter.

Therefore, a filter that does not affect the cavity quality factor and can implement the temperature compensation is needed.

SUMMARY OF THE INVENTION

Accordingly, embodiments of the present invention provide a method for manufacturing a resonance tube, a resonance tube, and a filter. In the embodiments of the present invention, a resonance tube is manufactured by selecting multiple powder materials and based on a powder metallurgy technology, and a relatively low linear expansion coefficient may be obtained according to an application frequency band of the filter, so that temperature compensation can be implemented on the filter without affecting a cavity quality factor.

In one aspect, an embodiment of the present invention provides a method for manufacturing a resonance tube, including: mixing powder materials, to form homogeneous powder particles, where the powder materials include iron powder with a weight proportion of 50% to 90%, at least one of copper powder and steel powder with a weight proportion of 1% to 30%, and an auxiliary material with a weight proportion of 1% to 20%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube.

In another aspect, an embodiment of the present invention provides a resonance tube, the resonance tube is manufactured according to a method for manufacturing a resonance tube according to an embodiment of the present invention, where the method includes: mixing powder materials, to form homogeneous powder particles, where the powder materials include iron powder with a weight proportion of 50% to 90%, at least one of copper powder and steel powder with a weight proportion of 1% to 30%, and an auxiliary material with a weight proportion of 1% to 20%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube.

In still another aspect, an embodiment of the present invention provides a filter, including: at least one resonance tube according to the embodiment of the present invention, and at least one tuning device set on the resonance tube, where the resonance tube is manufactured according to a method for manufacturing a resonance tube according to an embodiment of the present invention, and the method includes: mixing powder materials, to form homogeneous powder particles, where the powder materials include iron powder with a weight proportion of 50% to 90%, at least one of copper powder and steel powder with a weight proportion of 1% to 30%, and an auxiliary material with a weight proportion of 1% to 20%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube.

In still another aspect, an embodiment of the present invention provides a resonance tube, where the resonance tube is manufactured by using powder materials and based on a powder metallurgy technology, and the powder materials include iron powder with a weight proportion of 50% to 90%, at least one of copper powder and steel powder with a weight proportion of 1% to 30%, and an auxiliary material with a weight proportion of 1% to 20%.

In still another aspect, an embodiment of the present invention provides a filter, including: at least one resonance tube according to the embodiment of the present invention, and at least one tuning device set on the resonance tube, where the resonance tube is manufactured by using powder materials and based on a powder metallurgy technology, and the powder materials include iron powder with a weight proportion of 50% to 90%, at least one of copper powder and steel powder with a weight proportion of 1% to 30%, and an auxiliary material with a weight proportion of 1% to 20%.

Based on the foregoing technical solutions, in the method, the resonance tube, and the filter according to the embodiments of the present invention, the resonance tube is manufactured by selecting multiple powder materials and based on a powder metallurgy technology, so that a relatively low linear expansion coefficient may be obtained according to an application frequency band of the filter, and therefore temperature compensation can be performed on the filter without affecting the cavity quality factor, thereby guaranteeing electrical properties of the filter at different temperatures.

BRIEF DESCRIPTION OF THE DRAWINGS

To illustrate the technical solutions in the embodiments of the present invention more clearly, the following briefly describes the accompanying drawings needed for describing the embodiments. Apparently, the accompanying drawings in the following description merely show some embodiments of the present invention, and persons skilled in the art may derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the embodiments in the following description are merely a part rather than all of the embodiments of the present invention. All other embodiments obtained by persons skilled in the art based on the embodiments in the present invention without creative efforts shall fall within the protection scope of the present invention.

Figure 1:
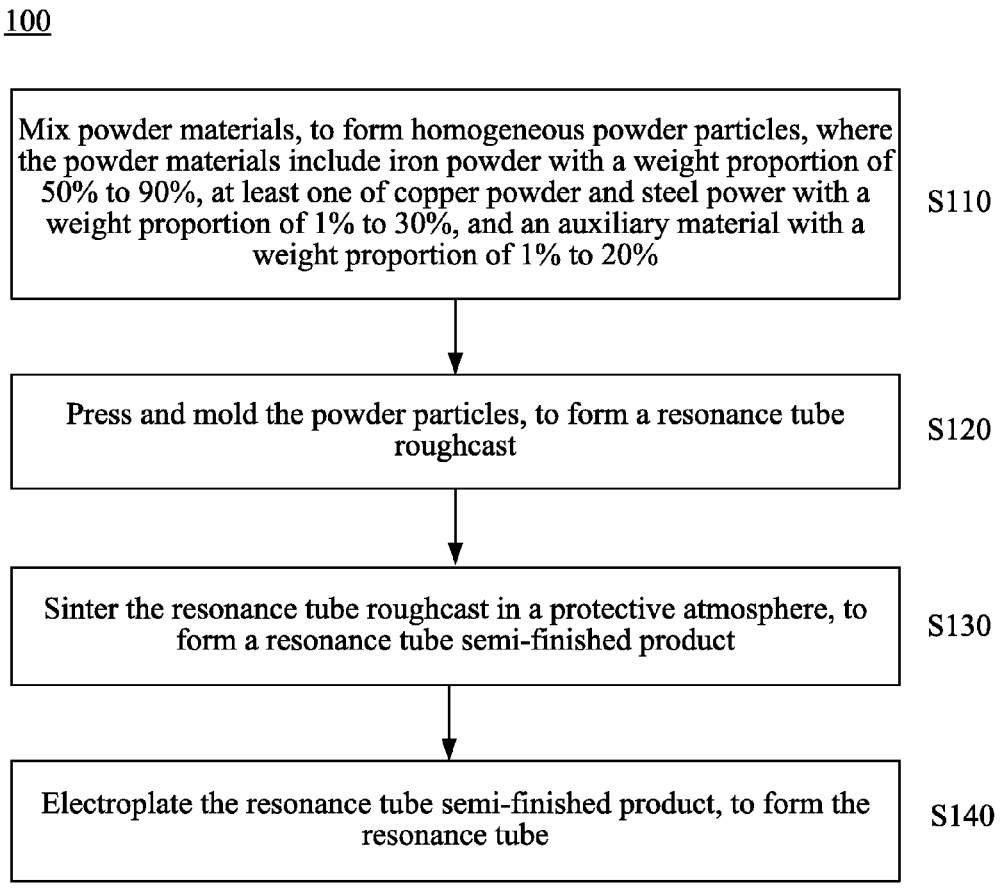
FIG. 1 is a flow chart of a method for manufacturing a resonance tube according to an embodiment of the present invention.

FIG. 1 is a flow chart of a method 100 for manufacturing a resonance tube according to an embodiment of the present invention. As shown in FIG. 1, the method 100 includes.

S110: Mix powder materials, to form homogeneous powder particles, where the powder materials include iron powder with a weight proportion of 50% to 90%, at least one of copper powder and steel powder with a weight proportion of 1% to 30%, and an auxiliary material with a weight proportion of 1% to 20%.

S120: Press and mold the powder particles, to form a resonance tube roughcast.

S130: Sinter the resonance tube roughcast in a protective atmosphere, to form a resonance tube semi-finished product.

S140: Electroplate the resonance tube semi-finished product, to form the resonance tube.

In the method according to the embodiment of the present invention, the resonance tube is manufactured by selecting multiple powder materials and based on a powder metallurgy technology, so that a relatively low linear expansion coefficient may be obtained according to an application frequency band of a filter, and therefore temperature compensation can be implemented on the filter without affecting a cavity quality factor, thereby guaranteeing electrical properties of the filter at different temperatures.

In the embodiment of the present invention, the powder materials for manufacturing the resonance tube may mainly include iron powder and copper powder, or mainly include iron powder and steel powder, or mainly include iron powder, copper powder, and steel powder. In addition, the powder materials may further include an auxiliary material. Optionally, the powder materials for manufacturing the resonance tube may further include at least one of zinc powder, nickel powder, molybdenum powder, and titanium powder, for example, the powder materials may mainly include iron powder, copper powder, and zinc powder; or include iron powder, copper powder, and nickel powder; or include iron powder, steel powder, and molybdenum powder; or include iron powder, steel powder, and titanium powder. Definitely, the powder materials may also include more than one of the zinc powder, nickel powder, molybdenum powder, and titanium powder; for example, the powder materials may include iron powder, copper powder, zinc powder, and titanium powder.

In the powder materials for manufacturing the resonance tube, the iron powder may have a weight proportion of 50% to 90%, for example, the iron powder in the powder materials may have a weight proportion of 50%, 60%, 70%, 80%, or 90%; and the copper powder and/or steel powder may have a weight proportion of 1% to 30%, for example, the copper powder and/or steel powder in the powder materials may have a weight proportion of 5%, 10%, 15%, 20%, 25%, or 30%. In another embodiment of the present invention, each of the copper powder, the steel powder, the copper and steel powder may also have a minimum weight proportion of 0, 1%, 2%, 3%, 4%, or 5%, and may also have a maximum weight proportion of 20%, 25%, 30%, 35%, 40%, or 45%. For example, each of the copper powder and steel powder may have a weight proportion of 2% to 40%, or a weight proportion of 5% to 45%.

When the powder materials for manufacturing the resonance tube further include at least one of the zinc powder, nickel powder, molybdenum powder, and titanium powder, the at least one powder may totally have a weight proportion similar to that of the copper powder or steel powder, for example, the powder materials for manufacturing the resonance tube include iron powder, steel powder, molybdenum powder, and titanium powder, where the molybdenum powder and titanium powder may totally have a weight proportion of 3% to 35%. Definitely, each of the at least one powder may have a weight proportion with a minimum value less than 2%, and a weight proportion with a maximum value less than 40%, for example, each of the at least one powder may have a weight proportion of 1% to 35%.

In the embodiment of the present invention, the powder materials for manufacturing the resonance tube, in addition to that the powder materials mainly include metals, may further include a metal auxiliary material and/or a non-metal auxiliary material, where the metal auxiliary material may include, for example, at least one of the copper powder, steel powder, zinc powder, nickel powder, molybdenum powder, and titanium powder, and the non-metal auxiliary material may include, for example, at least one of carbon powder, ceramic powder, and glass powder. For example, the powder materials may include the iron powder and ceramic powder, or include the iron powder, copper powder, and glass powder. The non-metal auxiliary material has a weight proportion of 1% to 20%, for example, the non-metal auxiliary material may have a weight proportion of 5%, 10%, or 15%. When the non-metal auxiliary material includes multiple non-metal materials, the non-metal materials totally have a weight proportion of 1% to 20%. For example, when the powder materials further include the ceramic powder and glass powder, the ceramic powder and glass powder may have a weight proportion of 0.5% and a weight proportion of 2% respectively, or the ceramic powder and glass powder may have a weight proportion of 10% and a weight proportion of 4% respectively.

Definitely, persons skilled in the art should understand that, the powder materials for manufacturing the resonance tube may further include other metal materials, and may also have other weight proportions. The foregoing examples are merely exemplary, and the embodiment of the present invention is not limited thereto.

In the embodiment of the present invention, constituents of the powder material and the weight proportions thereof are selected according to a frequency band, a range of a temperature change, and a temperature drift magnitude that are of the resonance tube or filter. For example, if a needed filter is used in a high frequency band, or an environment where the filter is used has a great temperature difference change, or a relevant apparatus has a high temperature drift requirement on the filter, metal powder with a low linear expansion coefficient may be selected, for example, titanium powder or steel powder, and a weight proportion of the metal powder may be increased. If an environment where the needed filter is used has a small temperature difference change, or a relevant apparatus does not have a high temperature drift requirement on the filter, metal powder with a high linear expansion coefficient and a low price may be selected, for example, copper powder or aluminum powder.

Therefore, in the method according to the embodiment of the present invention, the resonance tube may be manufactured by using multiple powder materials, so that a low linear expansion coefficient may be obtained, and the temperature compensation can be implemented on the filter; moreover, the powder materials may be selected, so as to adjust linear expansion coefficients of different resonance tubes according to an actual application condition. In addition, through the method according to the embodiment of the present invention, a cavity dimension of the resonance tube may not be changed, so that the temperature compensation can be implemented on filters with different frequency bands and cavity dimensions without affecting the cavity quality factor.

In addition, the method for manufacturing a resonance tube according to the embodiment of the present invention has advantages such as a low cost, high production efficiency, and desirable consistency.

Specifically, the cost of a high frequency band resonance tube manufactured according to the embodiment of the present invention is less than 0.50 yuan, while the cost of a resonance tube manufactured through metal machining is around 0.80 yuan, so a single resonance tube has a price difference of 0.30 yuan; and one cavity filter includes 24 resonance tubes for receiving, so each filter product may save the cost of 7.20 yuan. If 1.2 million filters are produced every year, through the method for manufacturing a resonance tube according to the embodiment of the present invention, the cost of 8.64 million yuan may be saved a year, thereby achieving high economic benefits.

In another aspect, through the method according to the embodiment of the present invention, the production efficiency may be improved to a great extent. For example, a powder molding apparatus can produce more than 20 thousand resonance tubes in batches a day, while a machine tool can only process about 500 resonance tubes a day, so through the method according to the embodiment of the present invention, the production efficiency of producing the resonance tube may be improved by 20 to 40 times; therefore, for a radio frequency product that needs to be urgently produced in large batches, production time may be greatly shortened, thereby saving a time cost.

In addition, in the powder metallurgy technology according to the embodiment of the present invention, a precise mold and a powder pressing technology are adopted; therefore, a product dimension is highly consistent with each other, for example, a height tolerance may generally be controlled within ±0.05 mm, so the method according to the embodiment of the present invention further has an advantage of high product consistency. In addition, during a process of manufacturing the resonance tube according to the embodiment of the present invention, no waste is produced, so a material utilization rate is high, and a material cost can be saved.

In the embodiment of the present invention, granularity of selected powder particles may be more than 200 meshes. Optionally, powder particles with a specific particle size may have a weight proportion as follows: the powder particles with a particle size less than 50 μm have a weight proportion of 0 to 10%; the powder particles with a particle size less than 100 μm and greater than or equal to 50 μm have a weight proportion of 70% to 100%; the powder particles with a particle size less than 150 μm and greater than or equal to 100 μm have a weight proportion of 0 to 20%; and the powder particles with a particle size greater than 150 μm have a weight proportion of 0 to 10%. Optionally, a median particle size of the powder particles is about 80 μm. Definitely, the selected powder particles may have smaller granularity.

Figure 2:
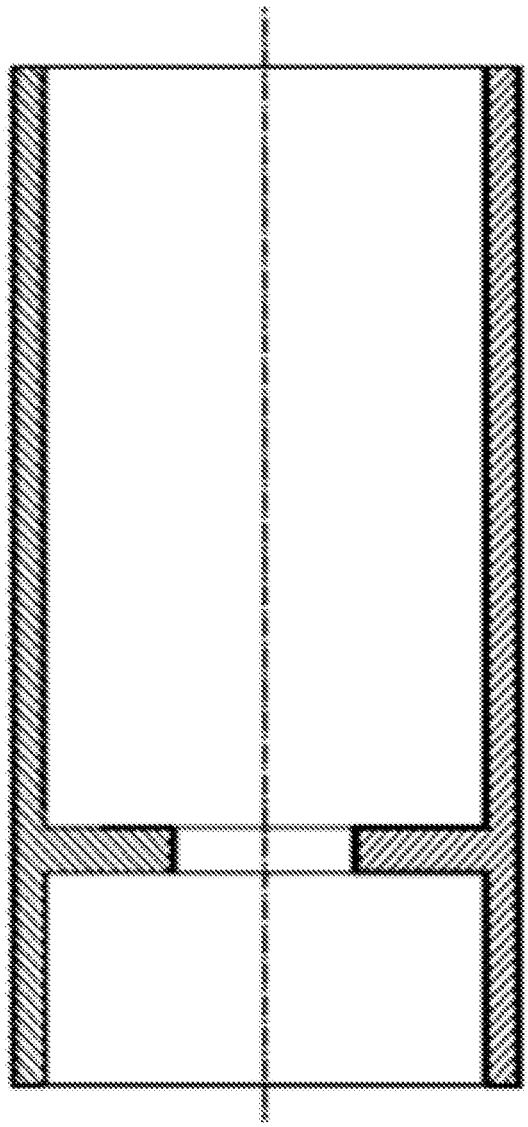
FIG. 2 is a schematic structural diagram of a resonance tube according to an embodiment of the present invention.

In the embodiment of the present invention, mixed powder materials may be further dried, to form homogeneous powder particles. Optionally, in the embodiment of the present invention, before the powder particles are pressed and molded, an organic adhesive with a mass proportion of 0.5% to 3% may be further added in the dried powder particles, and then granulation and sieving processing is performed, to form adhesive powder particles, so as to select needed granularity. Optionally, in the embodiment of the present invention, after the powder particles are pressed and molded, the resonance tube semi-finished product formed by pressing may be shaped, so as to improve the surface finish of the product. Optionally, in the embodiment of the present invention, hole sealing processing may further be performed on the shaped resonance tube semi-finished product, where the hole sealing processing may include: infiltrating the shaped resonance tube semi-finished product into at least one of a liquated zinc stearate, white oil, and silicone oil, so as to avoid a defect on an electroplated appearance that results from that pores of the semi-finished product absorb an electroplating solution during the electroplating; and drying the infiltrated resonance tube semi-finished product. Optionally, in the embodiment of the present invention, the electroplating the resonance tube semi-finished product may be: performing electrocoppering processing on the dried resonance tube semi-finished product, where a thickness of an electroplated copper layer is not less than 3 μm, for example, a thickness of a copper layer is 5 μm; and then performing electrosilvering processing on the electroplated copper layer, where optionally, a thickness of an electroplated silver layer is 3 μm to 5 μm. After the electroplating processing is performed on the resonance tube semi-finished product, a resonance tube shown in FIG. 2 may be formed.

Figure 3:
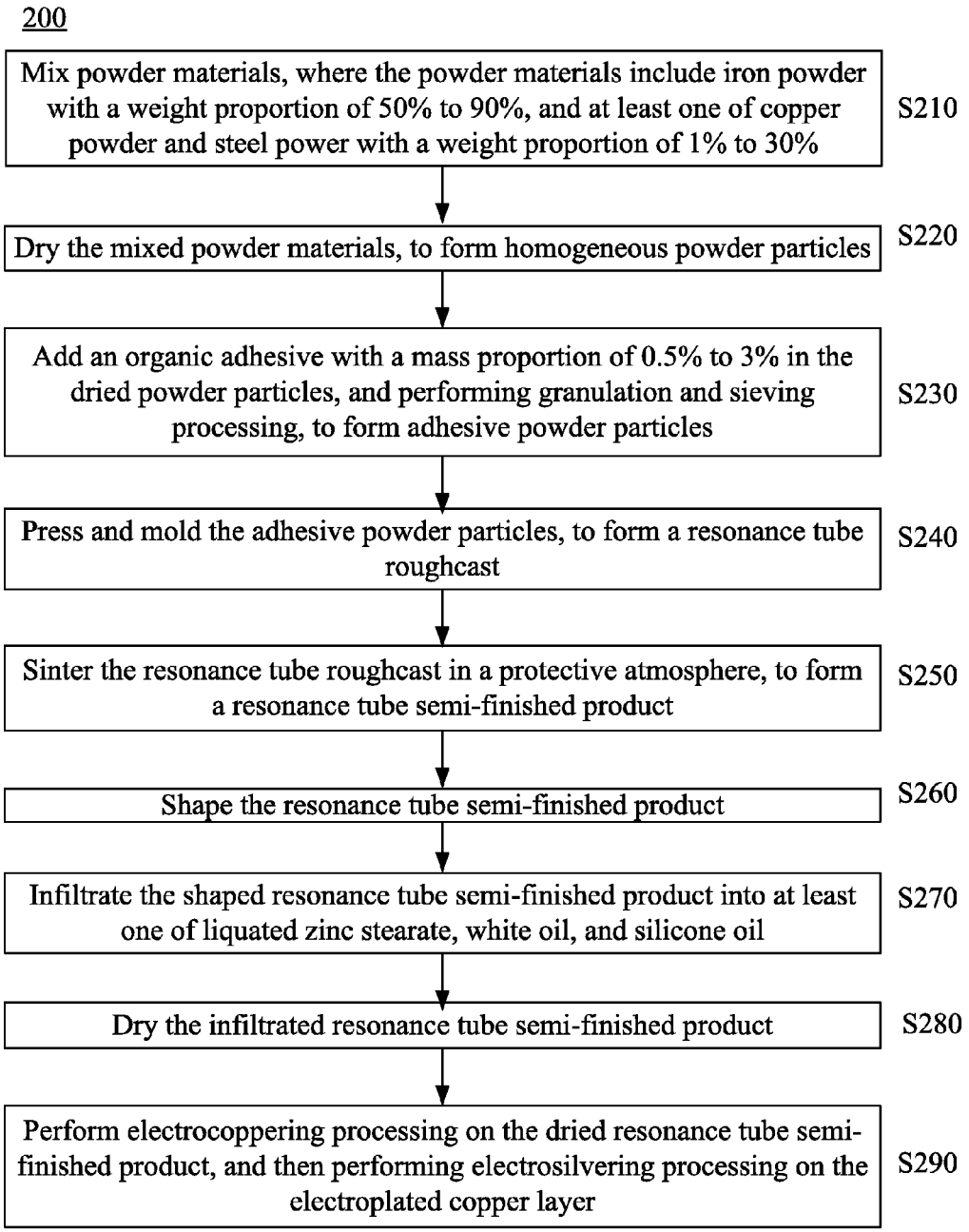
FIG. 3 is a flow chart of a method for manufacturing a resonance tube according to another embodiment of the present invention.

FIG. 3 is a flow chart of a method 200 for manufacturing a resonance tube according to another embodiment of the present invention. With reference to FIG. 3, the method 200 for manufacturing a resonance tube according to the embodiment of the present invention is described in detail in the following.

S210: Mix powder materials, where the powder materials include iron powder with a weight proportion of 50% to 90%, at least one of copper powder and steel powder with a weight proportion of 1% to 30%, and an auxiliary material with a weight proportion of 1% to 20%; specifically, powder materials with different weight proportions are weighed and selected for proportioning, then are mixed and stirred in a ball mill for 24 h to 48 h, and finally discharged after being homogeneously mixed; where the ball mill is adopted to mix and stir the powder materials, on one hand, the powder particles may be mixed more homogeneously, and on the other hand, the ball mill may grind the powder particles to a certain fineness.

S220: Dry the mixed powder materials, to form homogeneous powder particles, whereas the powder materials are easier to be homogeneously mixed through wet mixing, in the foregoing mixing processing, the wet mixing is usually adopted, so the mixed powder materials need to be dried to remove water, so as to form homogeneously mixed powder particles; for example, dry discharged slurry in an oven of 120° C. to 150° C. for 12 h.

S230: Add an organic adhesive with a mass proportion of 0.5% to 3% in the dried powder particles, and perform granulation and sieving processing, to form adhesive powder particles, so as to form needed granularity, where the organic adhesive includes at least one of stearic acid, zinc stearate, and polyvinyl alcohol; for example, add zinc stearate with a mass proportion of 1.5% in the dried powder particles, and perform the granulation and sieving processing.

S240: Press and mold the adhesive powder particles, to form a resonance tube roughcast, for example, add the adhesive powder particles into a powder molding machine, adjust a molding pressure to 5 to 10 tons, and press the powder particles into a resonance tube with a needed size, where the resonance tube may be 1.0 mm to 2.0 mm thick, or 1.3 mm to 1.8 mm thick, and optionally, the resonance tube may be 1.5 mm thick.

S250: Sinter the resonance tube roughcast in a protective atmosphere, to form a resonance tube semi-finished product; where the protective atmosphere includes a vacuum atmosphere, or at least one of hydrogen gas and inert gas, a sintering temperature may be 700° C. to 1150° C., sintering time may be 4 h to 10 h, and after the sintering, the resonance tube semi-finished product may have needed strength and hardness.

S260: Shape the resonance tube semi-finished product, so as to improve the surface finish of the resonance tube.

S270: Infiltrate the shaped resonance tube semi-finished product into at least one of a liquated zinc stearate, white oil, and silicone oil, so as to avoid an appearance defect during the electroplating, for example, infiltrate the semi-finished product into the silicone oil for 4 h to 24 h, and optionally, infiltrate for 12 h.

S280: Dry the infiltrated resonance tube semi-finished product. For example, put the semi-finished product into an oven of 100° C. to 150° C. for low-temperature drying, and then perform hole sealing processing.

S290: Perform electrocoppering processing on the dried resonance tube semi-finished product, and then perform electrosilvering processing on the electroplated copper layer, where the thickness of the electroplated layer may be determined according to a frequency band to be applied and a skin effect, for example, for a resonance tube applied in a 900 MHz frequency band, the electroplated layer needs to be 5 μm thick; and for a resonance tube applied in a frequency band more than 1800 MHz or 2600 MHz, the electroplated layer may need to be 3 μm thick; if the electroplated layer is too thick, the cost is increased, while if the electroplated layer is too thin, the resonance tube has a poor conductivity, thereby causing a high insertion loss of the filter, so the thickness of the electroplated layer may be selected as needed; in the embodiment of the present invention, the thickness of the electroplated copper layer is not less than 3 μm or not less than 5 μm, for example, the copper layer is 6 μm thick, and optionally, the electroplated silver layer is 3 μm to 5 μm thick; and definitely, other metals with a desirable conductivity may also be selected for electroplating, enabling the filter to have a desirable conductivity and a low insertion loss.

In the method according to the embodiment of the present invention, the resonance tube is manufactured by selecting multiple powder materials and based on a powder metallurgy technology, so that a relatively low linear expansion coefficient may be obtained according to an application frequency band of the filter, and therefore temperature compensation can be implemented on the filter without affecting a cavity quality factor, thereby guaranteeing electrical properties of the filter at different temperatures. In addition, in the method according to the embodiment of the present invention, powder materials may be selected, so as to adjust linear expansion coefficients of different resonance tubes according to an actual application condition, so that the temperature compensation can be implemented on filters with different frequency bands and cavity dimensions. In addition, the method according to the embodiment of the present invention has advantages such as a low cost, high production efficiency, and desirable consistency.

By taking two specific embodiments as examples, the method for manufacturing a resonance tube according to the embodiment of the present invention is described in detail in the following.

For a cavity filter applied in a personal communication service (Personal Communication Service, PCS for short)

frequency band (1920 MHz to 1980 MHz), a process of manufacturing a resonance tube of the cavity filter is as follows:

(1) selecting iron powder with a mass proportion of 50% to 90%, steel powder with a mass proportion of 1% to 30%, and graphite powder with a mass proportion of 1% to 20% for proportioning, optionally, selecting reduced iron powder with a mass proportion of 70%, steel powder with a mass proportion of 28%, and graphite powder with a mass proportion of 2% for proportioning, mixing and stirring the powder in a ball mill for 24 h to 48 h, for example, mixing and stirring for 48 h, and discharging the powder after being homogeneously mixed;

(2) drying discharged slurry in an oven of 120° C. to 150° C. for about 12 h, to form homogeneous powder particles;

(3) adding an organic adhesive with a mass proportion of 0.5% to 3% in the powder particles, for example, adding an organic adhesive with a mass proportion of 1%, and performing granulation and sieving, to form powder particles with certain adhesiveness;

(4) pressing and molding the adhesive powder particles in a powder molding machine, and adjusting a molding pressure to 5 to 10 tons;

(5) sintering a molded roughcast in a tunnel kiln with a hydrogen atmosphere at a high temperature of 700° C. to 1150° C. for 6 h, for example, a tunnel kiln at a high temperature of 1120° C.;

(6) shaping the sintered product;

(7) putting the shaped product in silicon oil, and then baking the product at a temperature of 100° C. to 150° C., and optionally, baking at a temperature of 120° C., so as to perform hole sealing processing; and (8) performing electrocoppering processing on the product which the hole sealing processing has been performed on, where an electroplated copper layer is thicker than 3 μm, for example, the electroplated copper layer is 8 μm thick, and then performing electrosilvering processing, where an electroplated silver layer is 3 μm to 5 μm thick.

In the foregoing method, after putting the manufactured resonance tube in a testing environment of −40° C. to +85° C., it is calculated that the resonance tube has a linear expansion coefficient of +8 ppm/° C. After the electroplated resonance tube product is installed in a cavity filter and is debugged, it is found that, when the filter is in the testing environment of −40° C. to +85° C., a temperature drift of the filter is less than 20 kHz, so it may be considered that the filter has no temperature drift.

For a filter applied in WiMAX 2.5 GHz with a bandwidth of 17 MHz, a method adopted for manufacturing a resonance tube of the filter is as follows:

(1) selecting a reduced iron powder with a weight proportion of 50%, copper powder with a weight proportion of 35%, and a nickel powder with a weight proportion of 15% for proportioning, mixing the powder materials in a ball mill for 24 h to 48 h, and discharging the powder materials after the powder materials are mixed homogeneously;

(2) drying discharged slurry in an oven of 120° C. to 150° C., to form homogeneous powder particles;

(3) adding an organic adhesive stearic acid with a weight proportion of 1% to 2% in the powder particles, and performing granulation and sieving, to form powder particles with certain adhesiveness;

(4) molding the adhesive powder particles into a powder molding machine, and adjusting a molding pressure to 6 to 8 tons;

(5) sintering a molded roughcast in a hydrogen atmosphere at a high temperature of 750° C. to 1200° C. for 8 h, for example, sintering the roughcast at a temperature of 820° C.;

(6) shaping the sintered product, so as to improve the surface finish of the product;

(7) infiltrating the shaped product in a silicon oil, and then baking the product at a low temperature of 80° C. to 100° C., to perform hole sealing processing; and (8) performing electrocoppering processing on the product which the hole sealing processing has been performed on, where an electroplated copper layer is 3 μm to 6 μm thick, and then performing electrocoppering processing, where an electroplated silver layer is 3 μm to 4 μm thick.

In the foregoing method, after the manufactured resonance tube is put in a testing environment of −40° C. to +85° C., it is calculated that the resonance tube has a linear expansion coefficient of +15.5 ppm/° C. After the electroplated resonance tube product is installed in a cavity filter and is debugged, it is found that, when the filter is in the testing environment of −40° C. to +85° C., a temperature drift of the filter is less than 30 kHz, so it may be considered that the filter has no temperature drift.

An embodiment of the present invention further provides a resonance tube, the resonance tube is manufactured according to the method for manufacturing a resonance tube according to the embodiment of the present invention, and the method includes: mixing powder materials, to form homogeneous powder particles, where the powder materials include iron powder with a weight proportion of 50% to 90%, and at least one of copper powder and steel powder with a weight proportion of 1% to 30%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube.

For the resonance tube according to the embodiment of the present invention, the resonance tube has a linear expansion coefficient ranging from +4 ppm/° C. to +16 ppm/° C. For example, the resonance tube may have a linear expansion coefficient of +6 ppm/° C., +8 ppm/° C., +10 ppm/° C., +12 ppm/° C., or +14 ppm/° C. In addition, the resonance tube may be 1.0 mm to 2.0 mm thick, or 1.3 mm to 1.8 mm thick, and optionally, the resonance tube may be 1.5 mm thick.

An embodiment of the present invention further provides a filter, including: at least one resonance tube according to the embodiment of the present invention, and at least one tuning device set on the resonance tube, where the tuning device is configured to adjust a resonance frequency of the resonance tube; the resonance tube is manufactured according to the method for manufacturing a resonance tube according to the embodiment of the present invention; and the method includes: mixing powder materials, to form homogeneous powder particles, where the powder materials include iron powder with a weight proportion of 50% to 90%, and at least one of copper powder and steel powder with a weight proportion of 1% to 30%; pressing and molding the powder particles, to form a resonance tube roughcast; sintering the resonance tube roughcast in a protective atmosphere, to form a resonance tube semi-finished product; and electroplating the resonance tube semi-finished product, to form the resonance tube.

Figure 4:
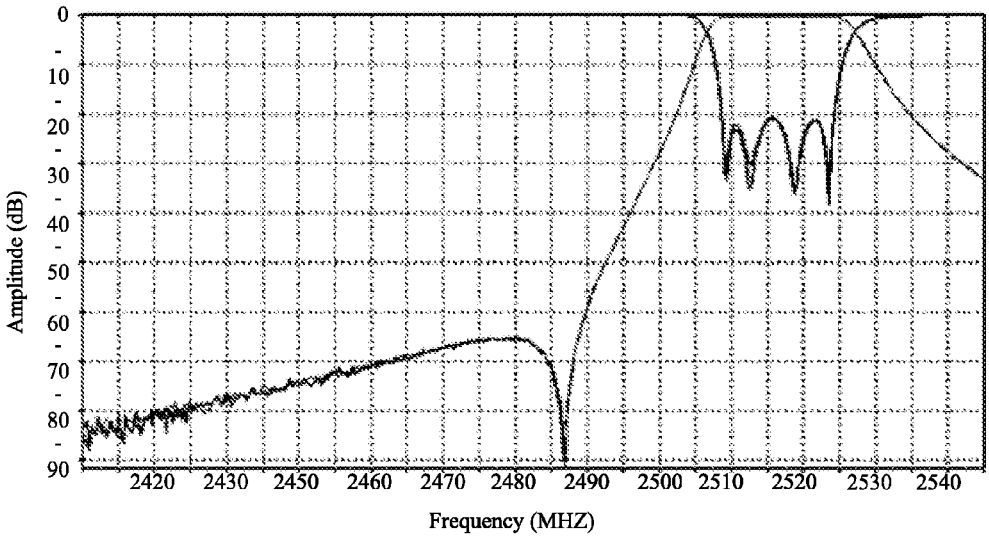
FIG. 4 is a curve comparison diagram of a temperature drift of a filter according to an embodiment of the present invention.

FIG. 4 is a curve comparison diagram of a temperature drift of a filter manufactured according to an embodiment of the present invention. FIG. 4 shows S parameter curves of a cavity filter applied in WiMAX 2.5 GHz and a bandwidth of 17 MHz at temperatures of +25° C. and +85° C. It may be seen from FIG. 4 that, the two curves almost coincide, namely, a passband of the filter does not drift at different temperatures, so the filter may be considered as a product with a zero temperature drift.

For the resonance tube and filter according to the embodiments of the present invention, the resonance tube is manufactured by selecting multiple powder materials and based on the powder metallurgy technology, so that a relatively low linear expansion coefficient may be obtained according to an application frequency band of the filter, and temperature compensation can be implemented on the filter, thereby guaranteeing electrical properties of the filter at different temperatures. In addition, in the method according to the embodiment of the present invention, the powder materials may be selected, so as to adjust linear expansion coefficients of different resonance tubes according to an actual application condition, thereby implementing temperature compensation on filters with different frequency bands and cavity dimensions; in this way, the product may be not only applied in cold areas, but also applied in hot African areas; moreover, the normal radio frequency index insertion loss of the filter is guaranteed, and normal work of a base station transceiver is also guaranteed. In addition, the resonance tube and filter according to the embodiments of the present invention further have advantages such as a low cost, high production efficiency, and desirable consistency.

An embodiment of the present invention further provides a resonance tube, where the resonance tube is manufactured by using powder materials and based on a powder metallurgy technology, and the powder materials include iron powder with a weight proportion of 50% to 90%, at least one of copper powder and steel powder with a weight proportion of 1% to 30%, and an auxiliary material with a weight proportion of 1% to 20%.

In the embodiment of the present invention, the powder materials may further include at least one of zinc powder, nickel powder, molybdenum powder, and titanium powder. Optionally, the powder materials may further include at least one of carbon powder, ceramic powder, and glass powder.

In the embodiment of the present invention, the resonance tube has a linear expansion coefficient ranging from +4 ppm/° C. to +16 ppm/° C. For example, the resonance tube may have a linear expansion coefficient of +6 ppm/° C., +8 ppm/° C., +10 ppm/° C., +12 ppm/° C., or +14 ppm/° C. In addition, the resonance tube may be 1.0 mm to 2.0 mm thick, or 1.3 mm to 1.8 mm thick, and optionally, the resonance tube may be 1.5 mm thick.

In the embodiment of the present invention, the surface of the resonance tube is electroplated with a copper layer, where the copper layer is not thinner than 3 μm. The copper layer of the resonance tube is further electroplated with a silver layer, where the silver layer is 3 μm to 5 μm thick.

An embodiment of the present invention further provides a filter, including: at least one resonance tube according to the embodiment of the present invention, and at least one tuning device set on the resonance tube, where the resonance tube is manufactured by using powder materials and based on a powder metallurgy technology, and the powder materials include iron powder with a weight proportion of 50% to 90%, at least one of copper powder and steel powder with a weight proportion of 1% to 30%, and an auxiliary material with a weight proportion of 1% to 20%.

For the resonance tube and filter according to the embodiments of the present invention, the resonance tube is manufactured by selecting multiple powder materials and based on the powder metallurgy technology, so that a relatively low linear expansion coefficient may be obtained according to an application frequency band of the filter, and temperature compensation can be implemented on the filter without affecting the cavity quality factor, thereby guaranteeing electrical properties of the filter at different temperatures; moreover, the powder materials can be selected, so as to adjust linear expansion coefficients of different resonance tubes, thereby implementing temperature compensation on filters with different frequency bands and cavity dimensions. In addition, the resonance tube and filter according to the embodiments of the present invention further have advantages such as a low cost, high production efficiency, and desirable consistency.

Persons skilled in the art may notice that, in combination with the examples described in the embodiments here, each of the steps in the methods and the units can be implemented by electronic hardware, computer software, or a combination thereof. To clearly describe the interchangeability between the hardware and the software, the foregoing has generally described compositions and steps of each embodiment according to functions. Whether the functions are executed by hardware or software depends on particular applications and design constraint conditions of the technical solutions. Person skilled in the art may use different methods to implement the described functions for each particular application, but it should not be considered that such implementation goes beyond the scope of the present invention.

The methods or steps described in combination with the embodiments disclosed here may be implemented by using hardware, a software program executed by a processor, or a combination thereof. The software program may be placed in a random access memory (RAM), a memory, a read-only memory (ROM), an electrically programmable ROM, an electrically erasable programmable ROM, a register, a hard disk, a removable magnetic disk, a CD-ROM, or a storage medium of any other form well-known in the technical field.

The present invention is described in detail with reference to the accompany drawings in combination with the exemplary embodiments, but it is not limited to the foregoing. Various equivalent modifications or replacements made by a person skilled in the art without departing from the idea and essence of the present invention shall fall within the scope of the present invention.

What is claimed is:

1. A method for manufacturing a resonance tube, comprising:

mixing powder materials to form homogeneously mixed powder particles, wherein the powder materials comprise iron powder with a weight proportion of between 50% and 90%, at least one of copper powder and steel powder with a weight proportion of between 1% and 30%, and an auxiliary material with a weight proportion of between 1% and 20%;

pressing and molding the powder particles to form a resonance tube roughcast;

sintering the resonance tube roughcast in a protective atmosphere to form a resonance tube semi-finished product; and electroplating the resonance tube semi-finished product to form the resonance tube.

2. The method according to claim 1, wherein the powder materials further comprise at least one of zinc powder, nickel powder, molybdenum powder, and titanium powder.

3. The method according to claim 1, wherein the powder materials further comprise at least one of carbon powder, ceramic powder, and glass powder.

4. The method according to claim 1, wherein the powder particles with a specific particle size have a weight proportion as follows:

the powder particles with a particle size less than 50 μm have a weight proportion of between 0% and 10%;

the powder particles with a particle size less than 100 μm and greater than or equal to 50 μm have a weight proportion of between 70% and 100%;

the powder particles with a particle size less than 150 μm and greater than or equal to 100 μm have a weight proportion of between 0% and 20%; and the powder particles with a particle size greater than 150 μm have a weight proportion of between 0% and 10%.

5. The method according to claim 1, further comprising:

drying the mixed powder materials to form homogeneously mixed powder particles.

6. The method according to claim 5, further comprising:

before the pressing and molding the powder particles, adding an organic adhesive with a mass proportion of between 0.5% and 3% in the dried powder particles, and performing granulation and sieving processing to form adhesive powder particles.

7. The method according to claim 6, wherein the organic adhesive comprises at least one of stearic acid, zinc stearate, and polyvinyl alcohol.

8. The method according to claim 1, wherein the protective atmosphere comprises a vacuum atmosphere, or at least one of hydrogen gas and inert gas.

9. The method according to claim 1, further comprising:

before the electroplating the resonance tube semi-finished product, shaping the resonance tube semi-finished product.

10. The method according to claim 9, further comprising:

before the electroplating the resonance tube semi-finished product, performing hole sealing processing on the shaped resonance tube semi-finished product.

11. The method according to claim 10, wherein the performing hole sealing processing on the shaped resonance tube semi-finished product comprises:

infiltrating the shaped resonance tube semi-finished product into at least one of liquated zinc stearate, white oil, and silicone oil; and drying the infiltrated resonance tube semi-finished product.

12. The method according to claim 11, wherein the electroplating the resonance tube semi-finished product comprises:

performing electrocoppering processing on the dried resonance tube semi-finished product, and then performing electrosilvering processing on an electroplated copper layer.

13. The method according to claim 12, wherein in the electrocoppering processing, a thickness of an electroplated copper layer is not less than 3 μm.

14. The method according to claim 12, wherein in the electrosilvering processing, a thickness of an electroplated silver layer is between 3 μm to 5 μm.

15. A method comprising forming a resonance tube from a powder, the powder including iron with a weight proportion between 50% and 90%, at least one of copper and steel with a weight proportion between 1% and 30%, and an auxiliary material with a weight proportion between 1% and 20%.

16. The method according to claim 15, wherein the resonance tube has a linear expansion coefficient ranging from +4 ppm/° C. to +16 ppm/° C.

17. The method according to claim 15, wherein the resonance tube has a thickness of 1.5 mm.

18. The method according to claim 15, further comprising setting a tuning device on the resonance tube.

19. A method comprising manufacturing a resonance tube using powder materials and based on a powder metallurgy technology, wherein the powder materials comprise iron powder with a weight proportion between 50% and 90%, at least one of copper powder and steel powder with a weight proportion between 1% and 30%, and an auxiliary material with a weight proportion between 1% and 20%.

20. The method according to claim 19, wherein the powder materials further comprise at least one of zinc powder, nickel powder, molybdenum powder, and titanium powder.

21. The method according to claim 19, wherein the powder materials further comprise at least one of carbon powder, ceramic powder, and glass powder.

22. The method according to claim 19, further comprising electroplating a surface of the resonance tube with a copper layer, a thickness of the copper layer being greater than or equal to 3 μm.

23. The method according to claim 22, further comprising electroplating the copper layer of the resonance tube with a silver layer, a thickness of the silver layer being between 3 μm and 5 μm.

24. The method according to claim 19, wherein the resonance tube has a linear expansion coefficient ranging from +4 ppm/° C. to +16 ppm/° C.

25. The method according to claim 19, wherein a thickness of the resonance tube is 1.5 mm.

26. The method according to claim 19 further comprising setting a tuning device on the resonance tube.

* * * * *